US006886204B2

(12) United States Patent
Kasatshko et al.

(10) Patent No.: US 6,886,204 B2
(45) Date of Patent: May 3, 2005

(54) MULTIPLE POSITION AIR MATTRESS SYSTEM

(76) Inventors: Victor M. Kasatshko, 1155 Dartford Dr., Tarpon Springs, FL (US) 34688; Nicholas J. Webb, 16314 Texas Springs Rd., Redding, CA (US) 96001

( * ) Notice: Subject to any disclaimer, the term of this patent is extended or adjusted under 35 U.S.C. 154(b) by 0 days.

(21) Appl. No.: 10/744,874

(22) Filed: Dec. 23, 2003

(65) Prior Publication Data

US 2004/0143906 A1 Jul. 29, 2004

Related U.S. Application Data

(63) Continuation-in-part of application No. 10/350,587, filed on Jan. 24, 2003.

(51) Int. Cl.[7] ..... A47C 20/04

(52) U.S. Cl. ..... 5/722; 5/733; 5/633; 5/710; 297/452.41

(58) Field of Search ..... 5/731–734, 710, 5/722, 615, 632–634; 297/452.41

(56) References Cited

U.S. PATENT DOCUMENTS

| | | | | | |
|---|---|---|---|---|---|
| 2,623,574 | A | | 12/1952 | Damsch | 155/47 |
| 3,308,489 | A | | 3/1967 | Winkler | 5/338 |
| 3,572,836 | A | | 3/1971 | Khanh | 297/456 |
| 3,606,623 | A | | 9/1971 | Aymar | 5/327 B |
| 3,740,095 | A | | 6/1973 | Nall | 297/454 |
| 3,740,774 | A | | 6/1973 | Powell | 5/12 |
| 3,742,526 | A | | 7/1973 | Lillard | 5/12 |
| 3,751,739 | A | | 8/1973 | Assmann | 5/12 |
| 3,890,658 | A | | 6/1975 | Petersilie | 5/2 |
| 3,902,759 | A | | 9/1975 | Monteforte et al. | 297/456 |
| 3,978,530 | A | * | 9/1976 | Amarantos | 5/615 |
| 4,173,045 | A | | 11/1979 | Osborn | 5/12 |
| 4,459,714 | A | * | 7/1984 | Lin | 5/655.3 |
| 4,518,203 | A | | 5/1985 | White | 297/456 |
| 4,639,960 | A | | 2/1987 | Quillen et al. | 5/455 |
| 4,685,163 | A | | 8/1987 | Quillen et al. | 5/455 |
| 4,829,614 | A | | 5/1989 | Harper | 5/436 |
| 4,836,605 | A | | 6/1989 | Greenwood et al. | 297/250 |
| 4,839,932 | A | | 6/1989 | Williamson | 5/68 |
| 4,873,731 | A | | 10/1989 | Williamson | 5/68 |
| 4,905,332 | A | * | 3/1990 | Wang | 5/655.3 |
| 4,941,221 | A | | 7/1990 | Kanzler | 5/60 |
| 5,058,225 | A | | 10/1991 | Annand | 5/449 |
| 5,170,522 | A | | 12/1992 | Walker | 5/615 |
| 5,311,625 | A | | 5/1994 | Barker et al. | 5/615 |
| 5,335,968 | A | | 8/1994 | Sheridan et al. | 297/250.1 |
| 5,345,630 | A | | 9/1994 | Healy | 5/454 |
| 5,506,012 | A | | 4/1996 | Wright et al. | 428/35.2 |
| 5,577,278 | A | | 11/1996 | Barker et al. | 5/615 |
| 5,699,569 | A | * | 12/1997 | Schwarz-Zohrer | 5/655 |

(Continued)

OTHER PUBLICATIONS

Advertisement for UK Airbeds, Airmats, Air Mattresses, Lilos For traveling, camping, pool, beach and seaside.

*Primary Examiner*—Michael Trettel
(74) *Attorney, Agent, or Firm*—Gordon & Jacobson, PC

(57) ABSTRACT

A multiple position air mattress system for achieving various support positions includes a first mattress, a second mattress, and a bellows unit attached to the second mattress. The bellows unit is extendable for either elevating the second mattress or providing a support for an individual. A pump unit is adapted to be fluidly connected to and for providing pressurized air to the first mattress, the second mattress and the bellows unit. The multiple position air mattress can assume a prone bed position with the mattresses longitudinally adjacent each other and the bellows unit deflated, a recessed lounge position with the mattresses longitudinally adjacent each other and the bellows unit inflated and atop the second mattress, an adjustable lounge position with the mattresses longitudinally adjacent each other and the bellows unit inflated under the second mattress, and a chair position with the first mattress under the second mattress, and the mattresses and bellows unit inflated.

24 Claims, 11 Drawing Sheets

U.S. PATENT DOCUMENTS

| | | | | |
|---|---|---|---|---|
| 5,787,531 | A | 8/1998 | Pepe | 5/710 |
| 5,806,115 | A | 9/1998 | Brown | 5/615 |
| 5,809,597 | A | 9/1998 | Shaw | 5/655.3 |
| D406,870 | S | 3/1999 | Bauman | D21/803 |
| 5,963,997 | A | 10/1999 | Hagopian | 5/654 |
| 5,966,762 | A | 10/1999 | Wu | 5/710 |
| 5,970,545 | A | 10/1999 | Garman et al. | 5/615 |
| 6,012,186 | A | 1/2000 | Soltani et al. | 5/614 |
| 6,042,186 | A * | 3/2000 | Kojic et al. | 297/452.41 |
| 6,058,538 | A | 5/2000 | Chapman et al. | 5/713 |
| D434,243 | S | 11/2000 | Casto et al. | D6/381 |
| 6,224,444 | B1 | 5/2001 | Klimenko | 441/130 |
| 6,499,166 | B1 | 12/2002 | Jones | 5/689 |
| 6,739,005 | B2 * | 5/2004 | Davis | 5/615 |
| 2003/0041378 | A1 | 3/2003 | Davis | 5/615 |

* cited by examiner

MULTIPLE POSITION AIR MATTRESS SYSTEM

CROSS REFERENCE TO RELATED APPLICATIONS

We hereby claim benefit under Title 35, United States Code, Section 120 of U.S. patent application Ser. No. 10/350,587 filed Jan. 24, 2003. This application is a continuation-in-part of the Ser. No. 10/350,587 application. The Ser. No. 10/350,587 application is currently pending. The Ser. No. 10/350,587 application is hereby incorporated by reference into this application.

BACKGROUND OF THE INVENTION

1. Field of the Invention

The present invention relates generally to air mattresses and more specifically it relates to a multiple position air mattress system for achieving various support positions.

2. Description of the Related Art

Air mattresses have been in use for years. A conventional air mattress is comprised of a rectangular flat structure that is inflatable forming a bed-like structure. Conventional air mattresses may have pumps built into them or may be inflated from an external air source. Conventional air mattresses are not capable of being positioned in more than a prone bed position. The present invention overcomes the inherent limitations contained within conventional air mattresses.

BRIEF SUMMARY OF THE INVENTION

In view of the foregoing disadvantages inherent in the known types of air mattresses now present in the prior art, the present invention provides a new multiple position air mattress system construction which can be utilized for achieving various support positions and support functions.

The general purpose of the present invention, which will be described subsequently in greater detail, is to provide a new multiple position air mattress system that has many of the advantages of the air mattresses mentioned heretofore and many additional features that result in a new multiple position air mattress system.

Thus, a primary object of the present invention is to provide a multiple position air mattress system that will overcome the shortcomings of the prior art devices.

Another object is to provide a multiple position air mattress system for achieving various support positions.

A further object is to provide a multiple position air mattress system that may form into various positions such as but not limited to a chair, a recessed lounge, a prone bed and an adjustable lounge.

An additional object is to provide a multiple position air mattress system that is efficient and easy to utilize.

A further object is to provide a multiple position air mattress system that may be stored in a compact storage position.

In accord with these objects, the present invention generally comprises a first relatively larger mattress, a second relatively smaller mattress mechanically coupled to the first mattress, and a bellows unit attached to the second mattress. Each of the first mattress, second mattress, and bellows unit is preferably separately inflatable through a separate valves. However, the bellows unit is optionally fluidly connected to the second mattress. If the bellows unit is fluidly coupled to the second mattress, a valve may be fluidly positioned between the second mattress and the bellows unit for limiting airflow to the bellows unit until a desired pressure within the second mattress has been achieved. A pump unit is provided for supplying pressurized air to the first mattress, the second mattress and the bellows unit.

With the first relatively larger mattress, the second mattress and the bellows, the mattress system of the invention can be utilized to implement a chair, a recessed lounge, a prone bed and an adjustable lounge. In particular, with the bellows deflated, and the first and second mattresses longitudinally adjacent each other, the system implements a prone bed. With the bellows unit inflated and atop the second mattress, the system implements a recessed lounge. With the bellows unit inflated and below the second mattress, the system implements an adjustable lounge. With the bellows unit inflated above the second mattress, and the first mattress located under the second mattress, the system implements a chair.

There has thus been outlined, rather broadly, the more important features of the invention in order that the detailed description thereof may be better understood, and in order that the present contribution to the art may be better appreciated. There are additional features of the invention that will be described hereinafter and that will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

Other objects and advantages of the present invention will become apparent to the reader and it is intended that these objects and advantages are within the scope of the present invention.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWINGS

In the drawings, like reference characters designate the same or similar parts throughout the several views.

DETAILED DESCRIPTION OF THE INVENTION

A. Overview

Figure 1:
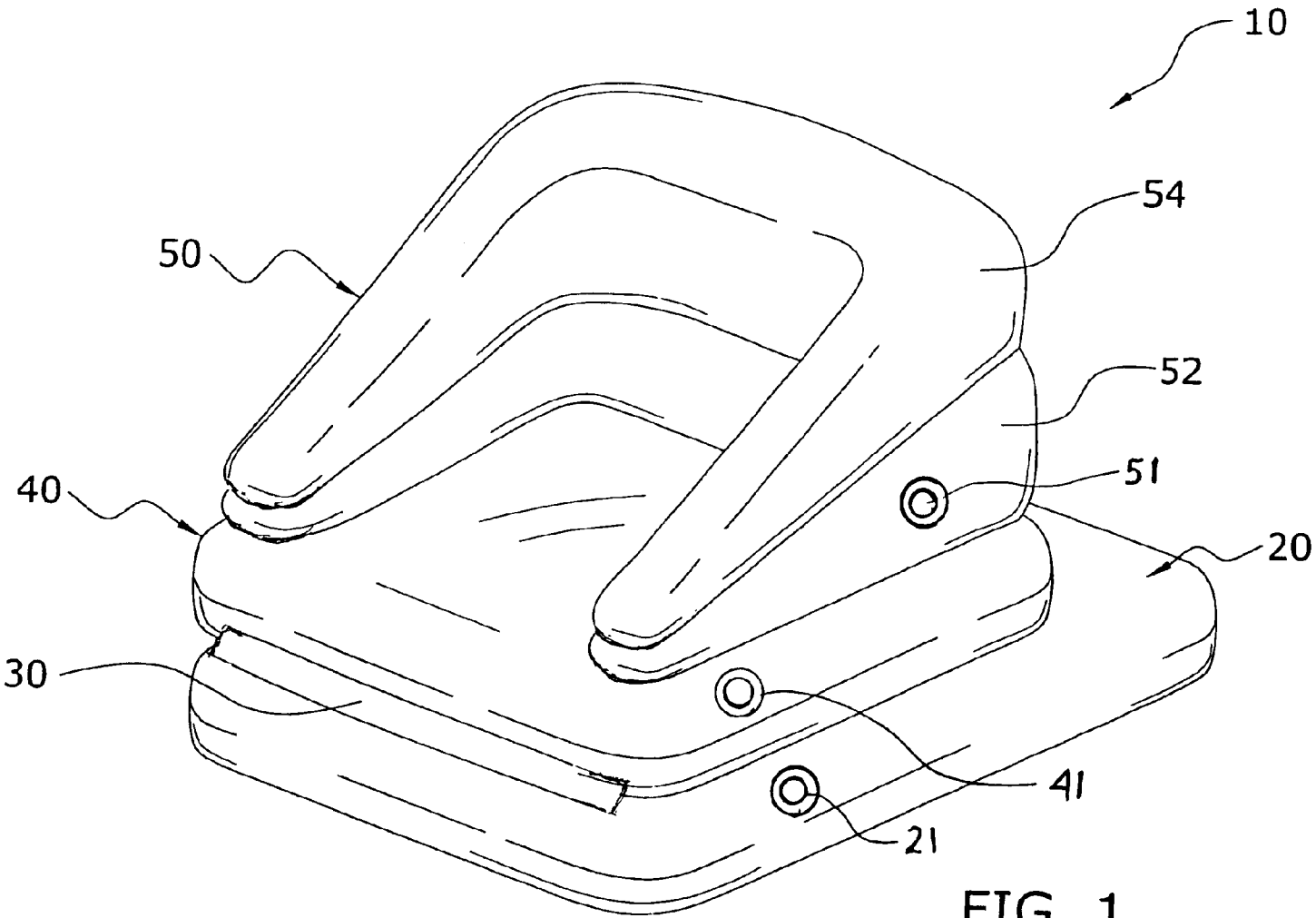
FIG. 1 is an upper perspective view of the present invention in the chair position.

Turning now descriptively to the drawings, in which similar reference characters denote similar elements throughout the several views, FIGS. 1 through 11 illustrate a multiple position air mattress system 10, which comprises a first mattress 20, a second mattress 40 connected to the first mattress 20 by a hinge member 30, and a bellows unit 50 attached to the second mattress 40. Each of the first mattress 20, the second mattress 40, and the bellows unit 50 is preferably provided with a respective air intake/outlet valve 21, 41, 51, for separately inflating or deflating that unit. Instead of an external intake/outlet valve, the bellows unit 50 may be fluidly connected to the second mattress 40 via an internal valve 70 (see FIG. 8) which is fluidly positioned between the second mattress 40 and the bellows unit 50 for limiting airflow to the bellows unit 50 until a desired pressure within the second mattress 40 has been achieved. A pump unit 60 is provided for providing pressurized air to the first mattress 20, the second mattress 40 and the bellows unit 50.

A. First Mattress

FIGS. 1 through 7 illustrate the first mattress 20. The first mattress 20 is inflatable via valve 21 and may be comprised of various inflatable structures and shapes. The first mattress 20 is preferably comprised of flocked PVC having a thickness of 2 mils, although it may be comprised of various materials capable of retaining pressurized air within. In addition, the first mattress may have an internal coil or other support structure such as a series of cylindrical or otherwise shaped columns (not shown) coupling the top and bottom surfaces of the mattress. The first mattress 20 may also be coated or covered with various types of materials. The first mattress 20 in the preferred embodiment is (when inflated) approximately forty-two inches long, thirty-nine inches wide, and nine inches high. The first mattress may further be provided with one or more slots or holes (not shown) on either side of the mattress so that the mattress may be coupled by a belt or other coupling means to a similar first mattress, when the mattress system is used as part of a king-sized bed arrangement.

B. Second Mattress

Figure 2:
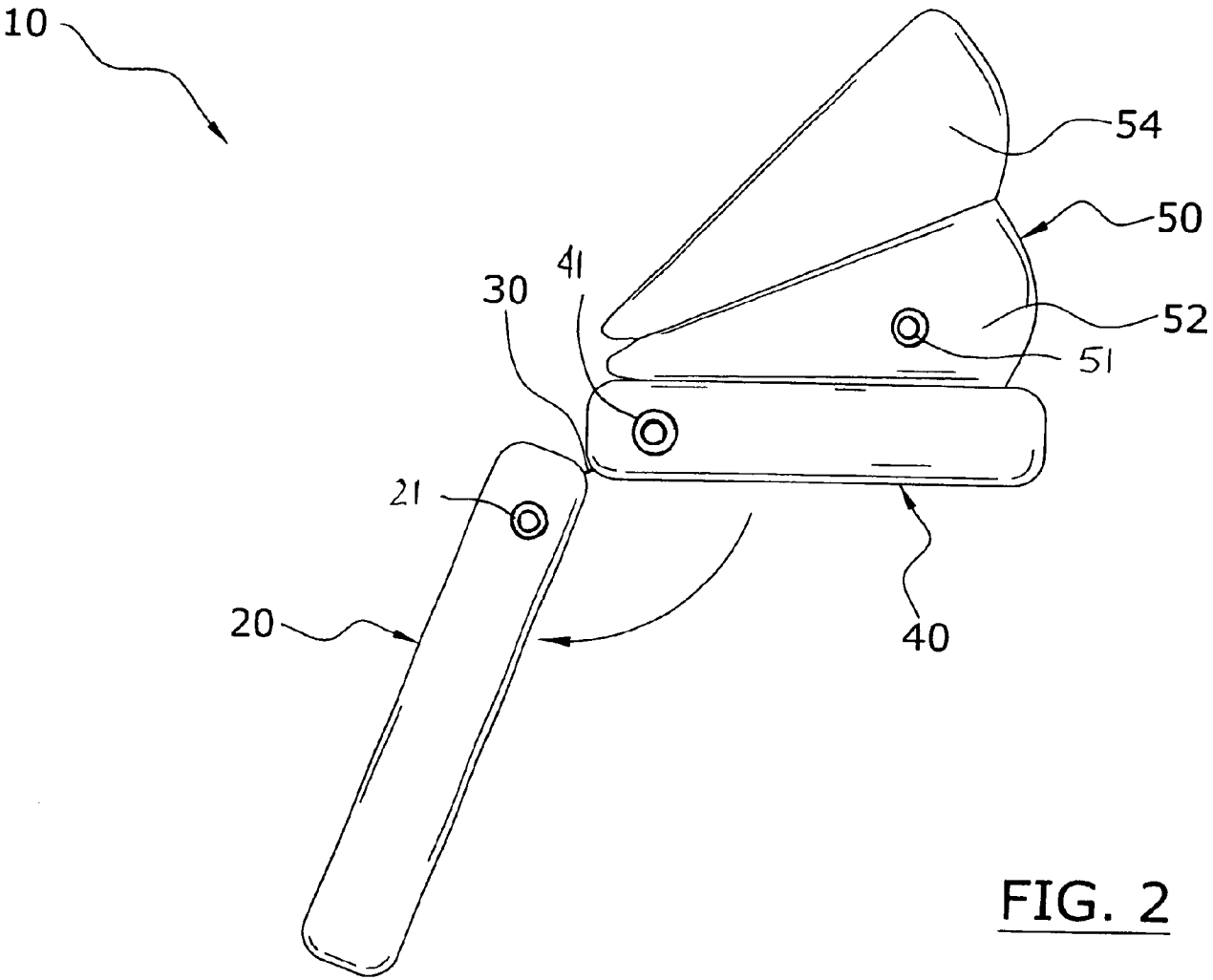
FIG. 2 is a side view of the present invention being converted from the chair position to the recessed lounge position.
Figure 3:
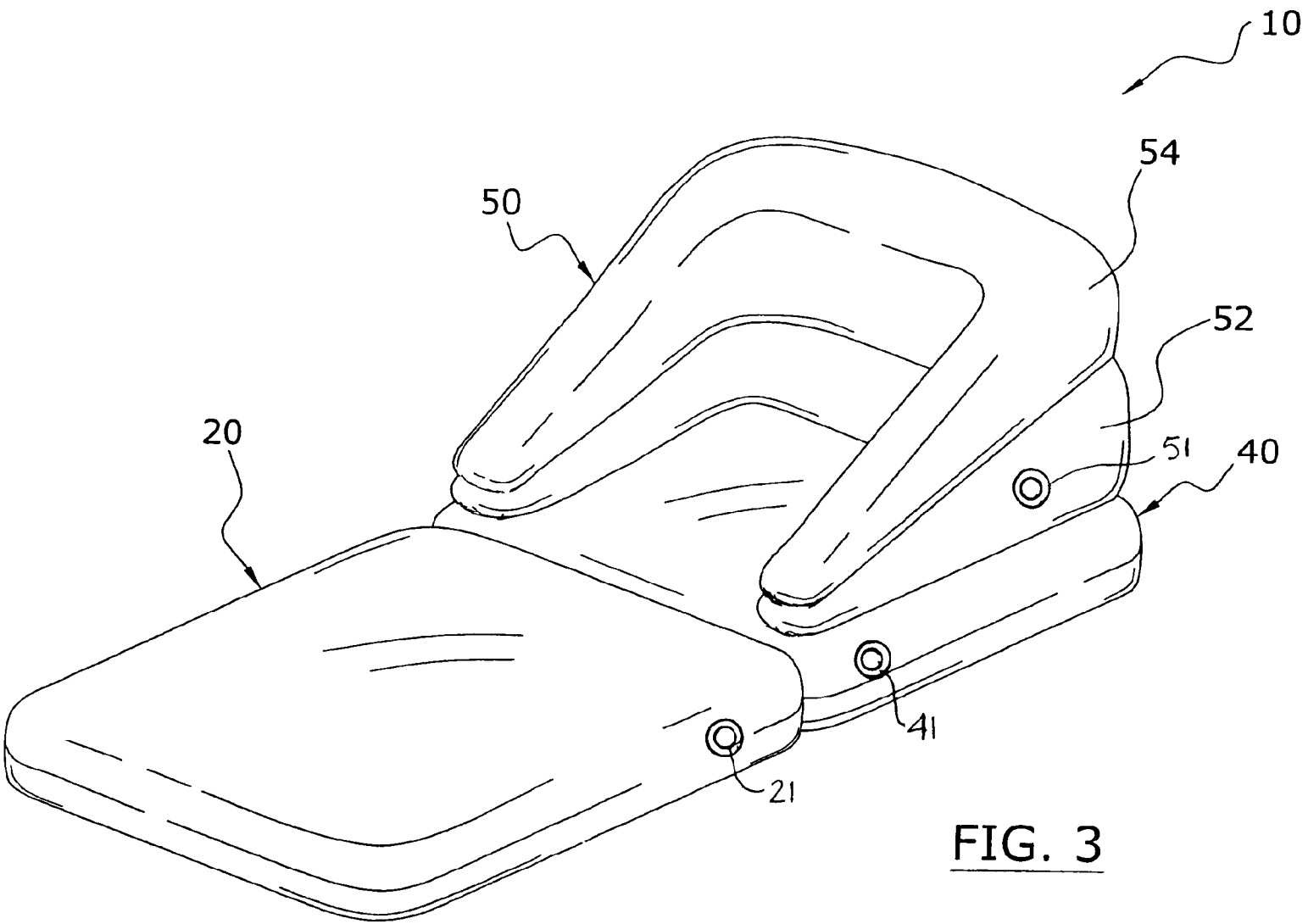
FIG. 3 is an upper perspective view of the present invention in the recessed lounge position.
Figure 4:
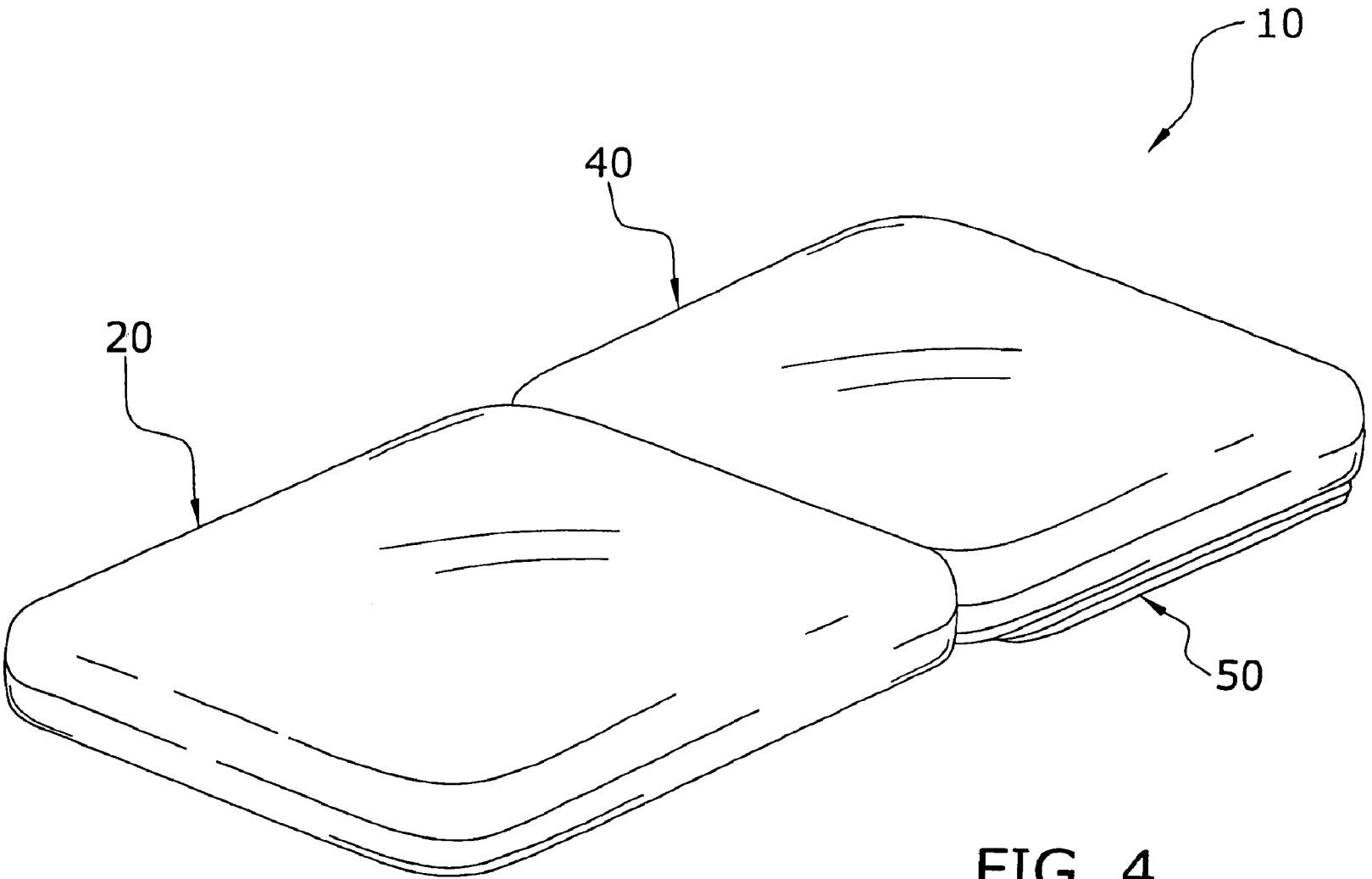
FIG. 4 is an upper perspective view of the present invention in the prone bed position.

FIGS. 1 through 7 illustrate the second mattress 40. The second mattress 40 is inflatable via valve 41 and may be comprised of various inflatable structures and shapes similar to the first mattress 20. The second mattress 40 is preferably comprised of flocked PVC having a thickness of 2 mils, although it may be comprised of various materials capable of retaining pressurized air within. In addition, the second mattress may have an internal coil or other support structure such as a series of cylindrical or otherwise shaped columns (not shown). The second mattress 40 may also be coated or covered with various types of materials. The second mattress 20 preferably has a structure similar to the first mattress 40 as best illustrated in FIG. 4 of the drawings, however the mattresses 20, 40 may have different structures. The second mattress 40 in the preferred embodiment (when inflated) is approximately thirty-three inches long, thirty-seven inches wide, and nine inches high.

The second mattress 40 is preferably pivotally connected (via hinge member 30) to the first mattress 20 as best illustrated in FIG. 2 of the drawings. The first mattress 20 and the second mattress 40 combined in a flat structure form a prone twin-sized bed structure as best illustrated in FIG. 4 of the drawings.

If desired, the second mattress 40 may be fluidly connected (via a tube—not shown) to the first mattress 20 to allow for simultaneous inflation and deflation. However, in the preferred embodiment of the invention, the second mattress 40 is not fluidly connected to the first mattress 20 and is inflated separately by the pressurized air source. This permits the first and second mattresses to be inflated to different pressure levels, which is desirable in providing desired support levels to different parts of the body. For example, because the human torso weighs considerably more than the legs, it may be desirable to inflate the second mattress to a higher degree than the first mattress, thereby providing more support to the torso.

C. Hinge Member

Figure 7:
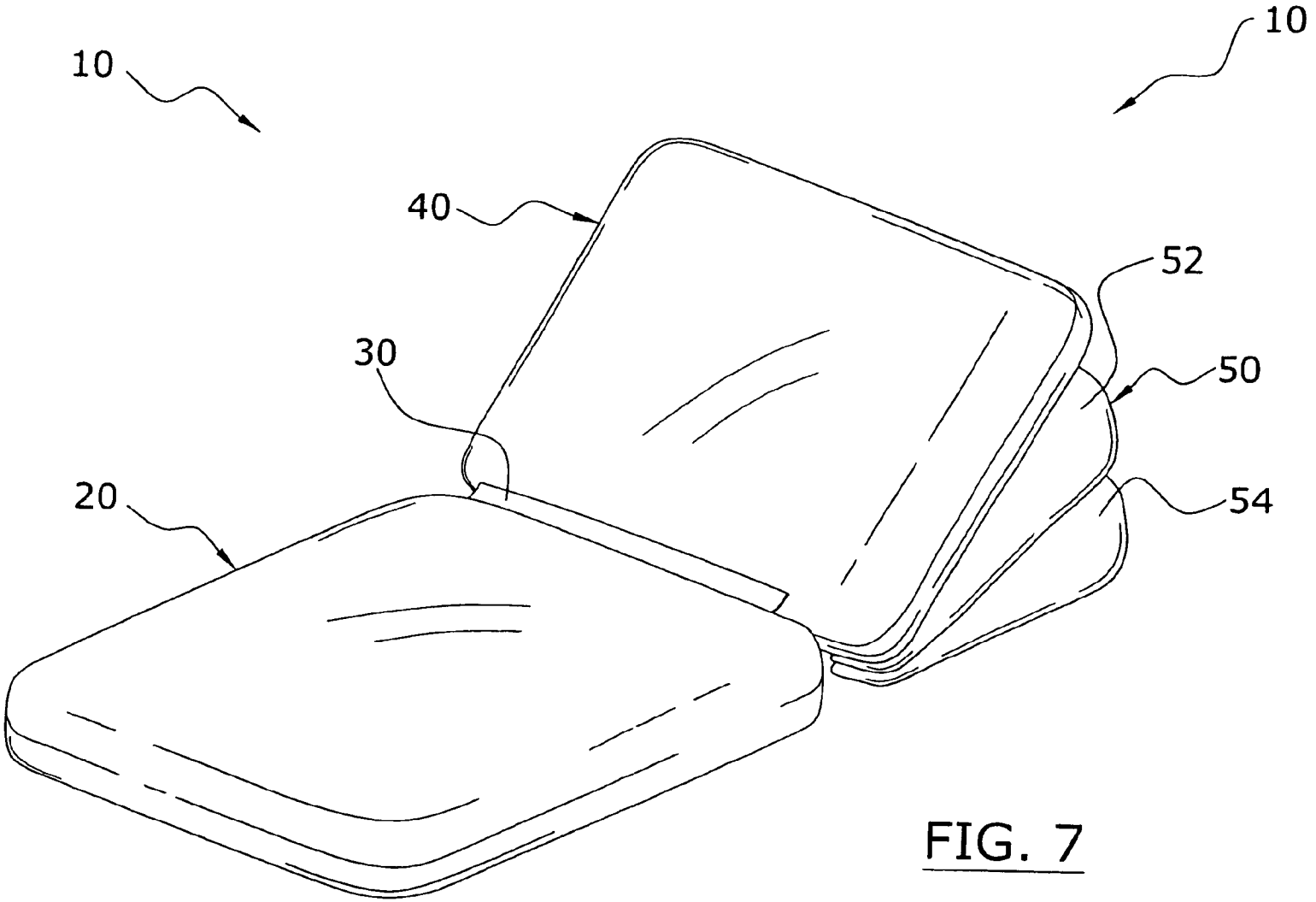
FIG. 7 is an upper perspective view of the present invention in the adjustable lounge position.

A hinge member 30 is preferably attached between the first mattress 20 and the second mattress 40 for pivotally supporting the same as best illustrated in FIGS. 2 and 7 of the drawings. The hinge member 30 is preferably comprised of a flexible and flat piece of flocked PVC of 2 mils thickness. The hinge member 30 is preferably heat sealed to both the first mattress 20 and the second mattress 40, and is preferably located near the top surfaces (i.e., the surface opposite the surface of the bellows) of the first and second mattresses so that when the first and second mattresses are longitudinally arranged in a bed structure, the hinge member 30 fills the crack between the mattresses and provides a relatively continuous surface for the bed. Various other structures and configurations may be utilized to pivotally attached the first mattress 20 and the second mattress 40 together.

D. Bellows Unit

Figure 5:
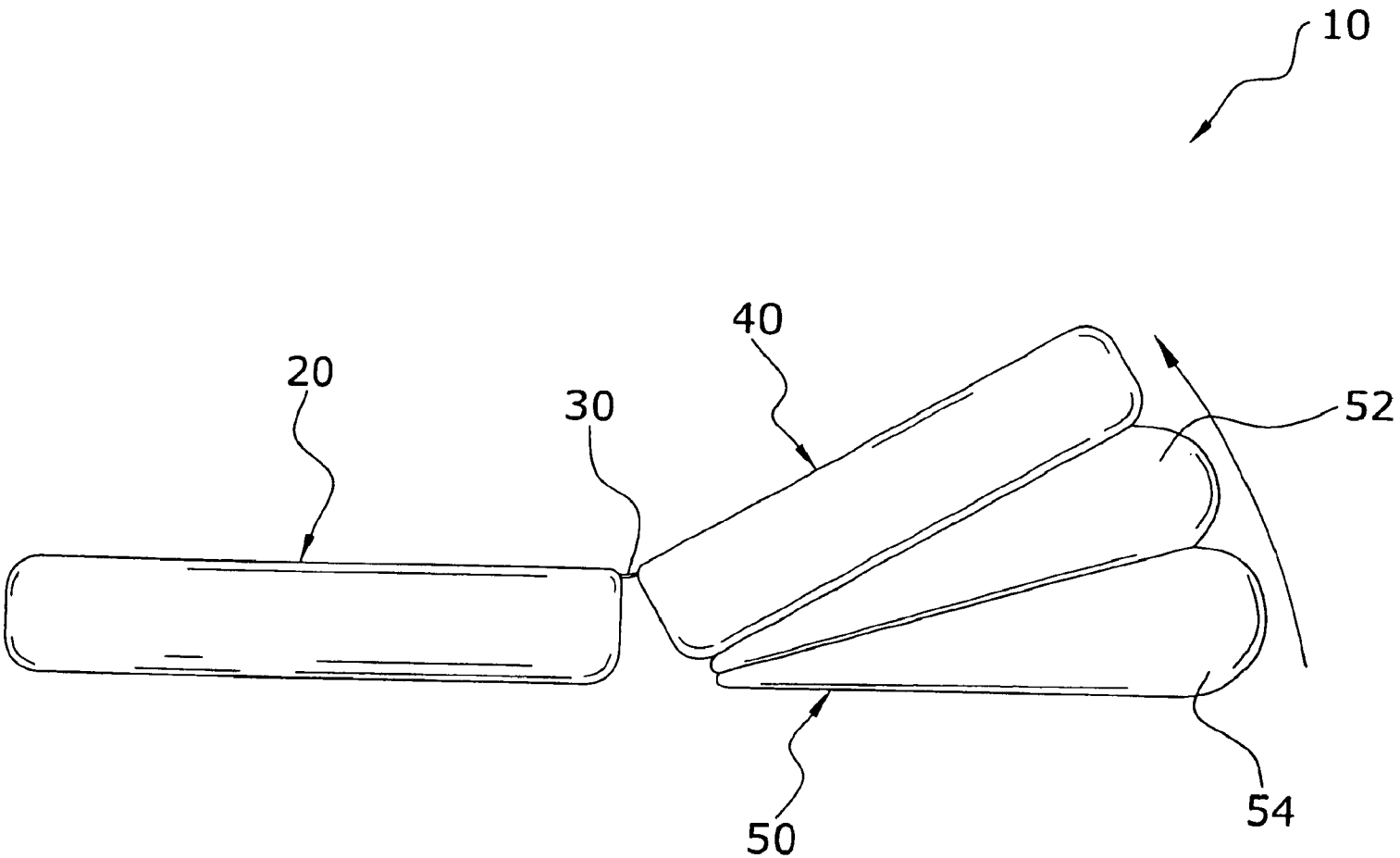
FIG. 5 is a side view of the present invention being converted from the prone bed position to the adjustable lounge position.
Figure 6:
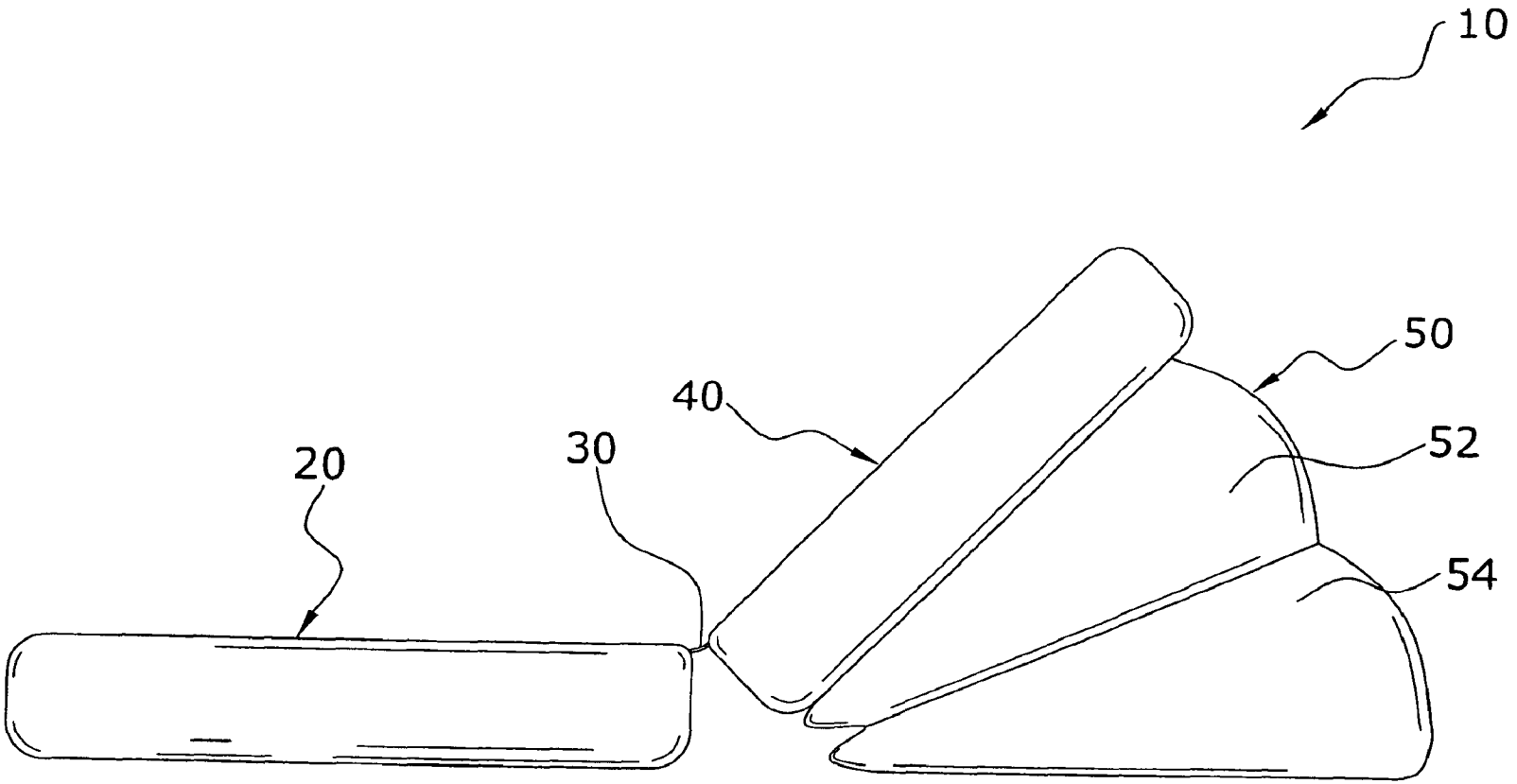
FIG. 6 is a side view of the present invention fully extended into the adjustable lounge position.

The bellows unit 50 is attached to the second mattress 40 as illustrated in FIGS. 1 through 7 of the drawings. The bellows unit 50 is comprised of one or more bellows. FIGS. 5 and 6 best illustrate the bellows unit 50 having a first bellows 52 attached to a lower side of the second mattress 40 and a second bellows 54 attached to the first bellows 52. The second bellows 54 is preferably fluidly connected to the first bellows 52 to allow for simultaneous or conditioned pressurization of the first bellows 52 and the second bellows 54 (via valve 51).

The bellows unit 50 preferably has a U-shaped structure which is highest at the back, and which tapers down in the front. The bellows unit, when completely inflated, is approximately twenty inches high at the back, and approximately eight inches high at the front of the arms. The arms are about five inches wide at the front (although they are preferably radiused with a radius of between 2 and 2.5 inches at their very front end), and they taper in width as they extend backwards such that the back of the bellows unit 50 is about twelve inches wide. From the tip of the arms to the back of the back, and from the outside of each of the arms, the U-shaped bellows unit 50 is approximately the same size as the second mattress 40; i.e., about thirty-seven inches across the arms and thirty-four inches from front to back.

When located under the second mattress and inflated, the first bellows 52 and the second bellows 54 elevate the second mattress 40 to a desired angle (preferably from zero degrees up to forty-five degrees) with respect to the first mattress 20 as best illustrated in FIGS. 5 and 6 of the drawings, thereby providing an adjustable lounge. When flipped over to be located above the second mattress, the bellows provide a recessed lounge structure as shown in FIG. 3 of the drawings.

Figure 8:
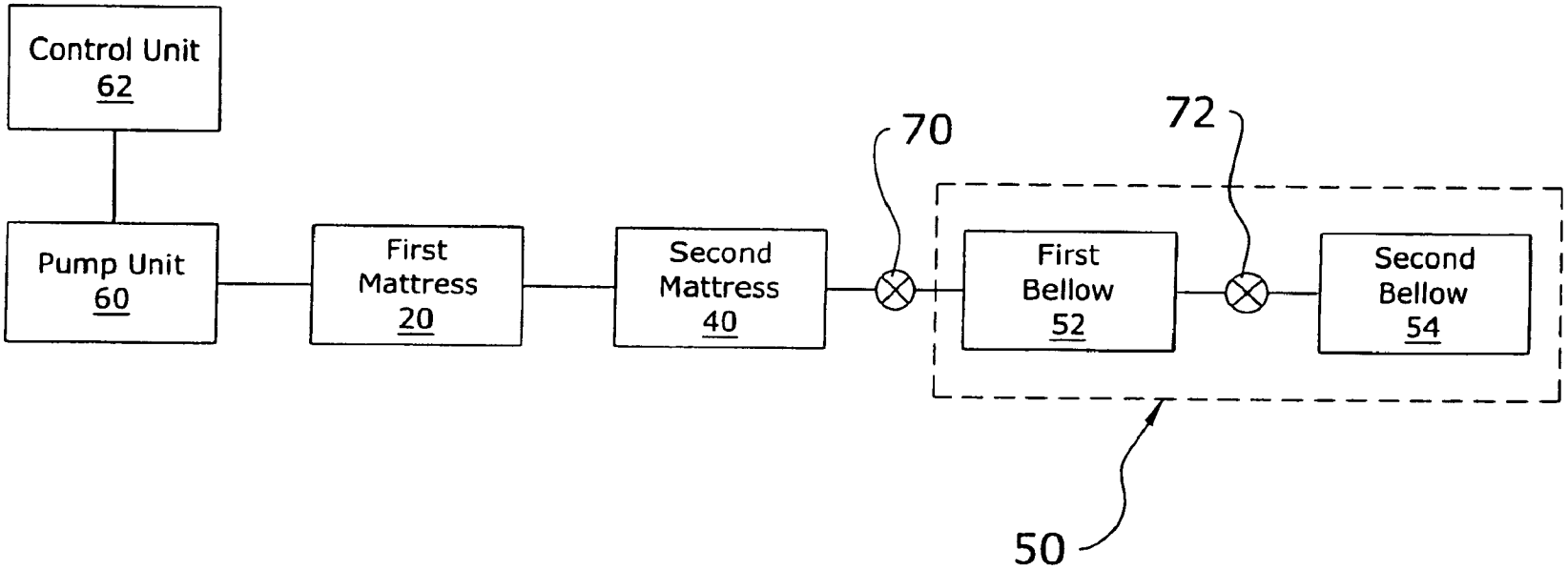
FIG. 8 is a block diagram illustrating the fluid connections of an alternative embodiment of the invention.

The first bellows 52 may be fluidly connected (via first valve 70) to the second mattress 40 as shown in FIG. 8 of the drawings. However, in the preferred embodiment of the invention, the first bellows 52 separately receives pressurized air from the pressurized air source. In any event, according to the preferred embodiment of the invention, the extent of inflation of the bellows unit should be controllable by the user. The second bellows 54 is preferably fluidly connected to the first bellows 52 as shown in FIG. 8 of the drawings. However, if desired, the second bellows 54 may be separately pressurized via another valve (not shown).

Figure 12:
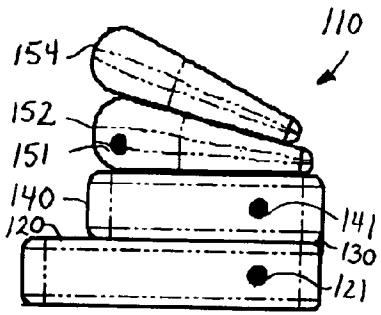
FIG. 12 is a side view of another alternative embodiment of the invention.

According to another embodiment of the invention shown in FIG. 12, a mattress system 110 is provided with a first mattress 120 having an inflation/deflation valve 121, a second mattress 140 with an inflation/deflation valve 141, a hinge 130, and a modified bellows unit 150 having first bellows 152, second bellows 154, and an inflation/deflation valve 151. In the alternative embodiment of FIG. 12, the second bellows 154 is seen to be slightly set back relative to the first bellows (i.e., the base of the second bellows 154 is pushed back relative to the top surface of the first bellows 152) such that the rear of the second mattress 140, the first bellows 152, and the second bellows 154 align substantially vertically. This arrangement provides more comfort in the seated position.

E. Valves

In the preferred embodiment of the invention, each of the mattresses and the bellows unit is provided with its own respective inflation/deflation valve 21, 41, 51. An additional valve (not shown) may be provided to inflate the second bellows 54 separately from the first bellows 54 if they are not fluidly connected.

According to another embodiment of the invention seen in FIG. 8, a first valve 70 is fluidly positioned between the second mattress 40 and the bellows unit 50 for allowing airflow from the second mattress 40 to the bellows unit 50 after the air pressure within the second mattress 40 has exceeded a desired level. The first valve 70 is preferably comprised of a pressure valve structure and preferably only allows airflow into the bellows unit 50 after the second mattress 40 has been partially or fully inflated. More particularly, the first valve 70 is preferably fluidly connected to the first bellows 52 within the bellows unit 50 as shown in FIG. 8 of the drawings.

In the second embodiment a second valve 72 is preferably fluidly positioned between the first bellows 52 and the second bellows 54 as shown in FIG. 8 of the drawings. The second valve 72 is designed for allowing airflow from the first bellows 52 to the second bellows 54 after the air pressure within the first bellows 52 has exceeded a desired level. The second valve 72 is preferably comprised of a pressure valve structure similar to the first valve 70 and preferably only allows airflow into the second bellows 54 after the first bellows 52 has been partially or fully inflated. The second valve 72 may also be provided in the preferred embodiment of the invention.

F. Pump Unit

A pump unit 60 is fluidly connected to the first mattress 20 as shown in FIG. 8 of the drawings. The pump unit 60 may be comprised of any pump structure capable of providing pressurized air. The pump unit 60 may be external or internal of the first mattress 20. The pump unit 60 may also be directly or indirectly fluidly connected to the second mattress 40, and the bellows unit 50. Various other pressurized air sources may be utilized with respect to the present invention. A control unit 62 is preferably in communication with the pump unit for controlling the operation of the pump unit 60 and the airflow to the first mattress 20, the second mattress 40 and the bellows unit 50.

G. Support Member

Figure 9:
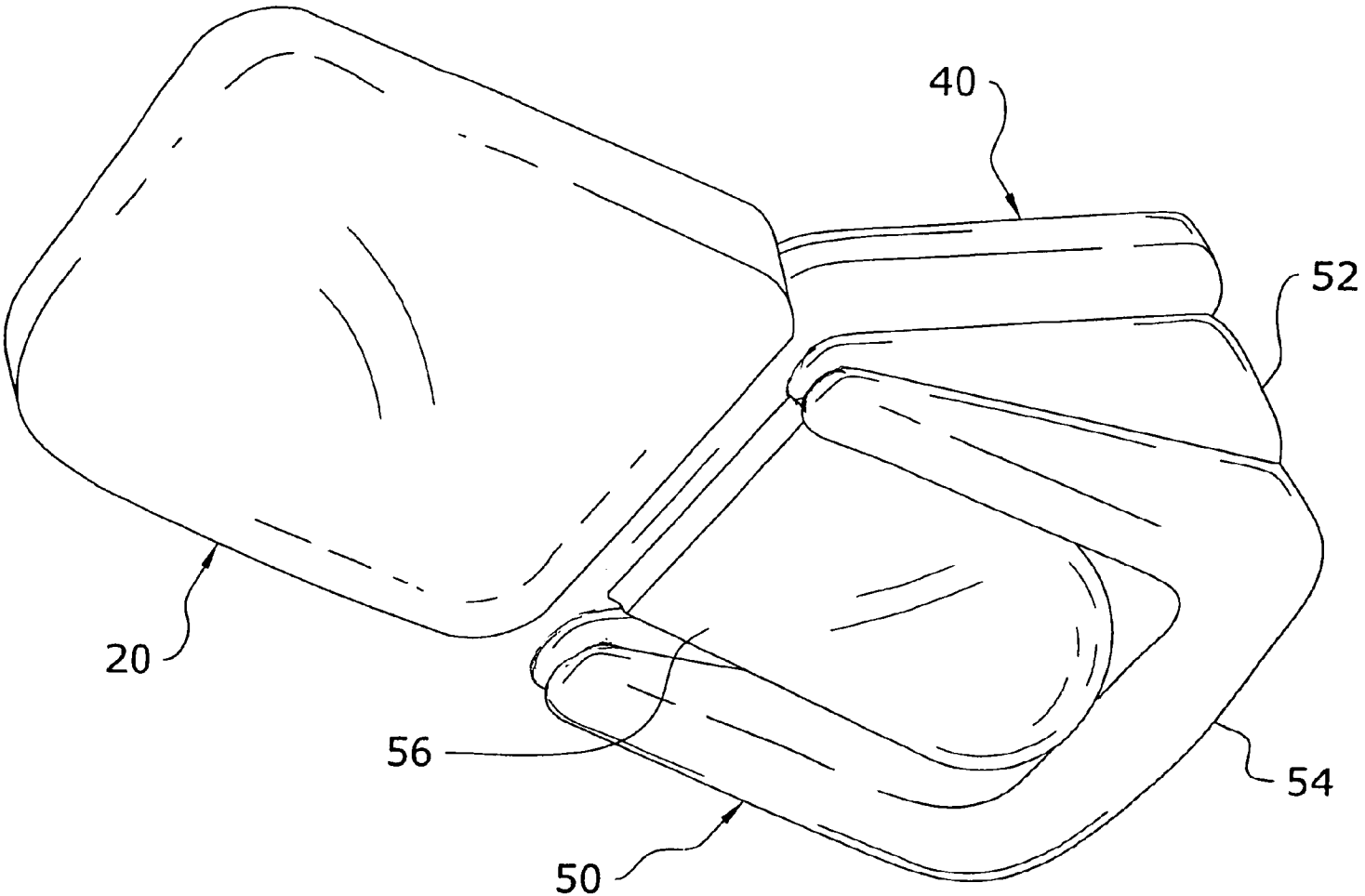
FIG. 9 is a lower perspective view of the present invention with a support member positioned between the bellows unit.
Figure 10:
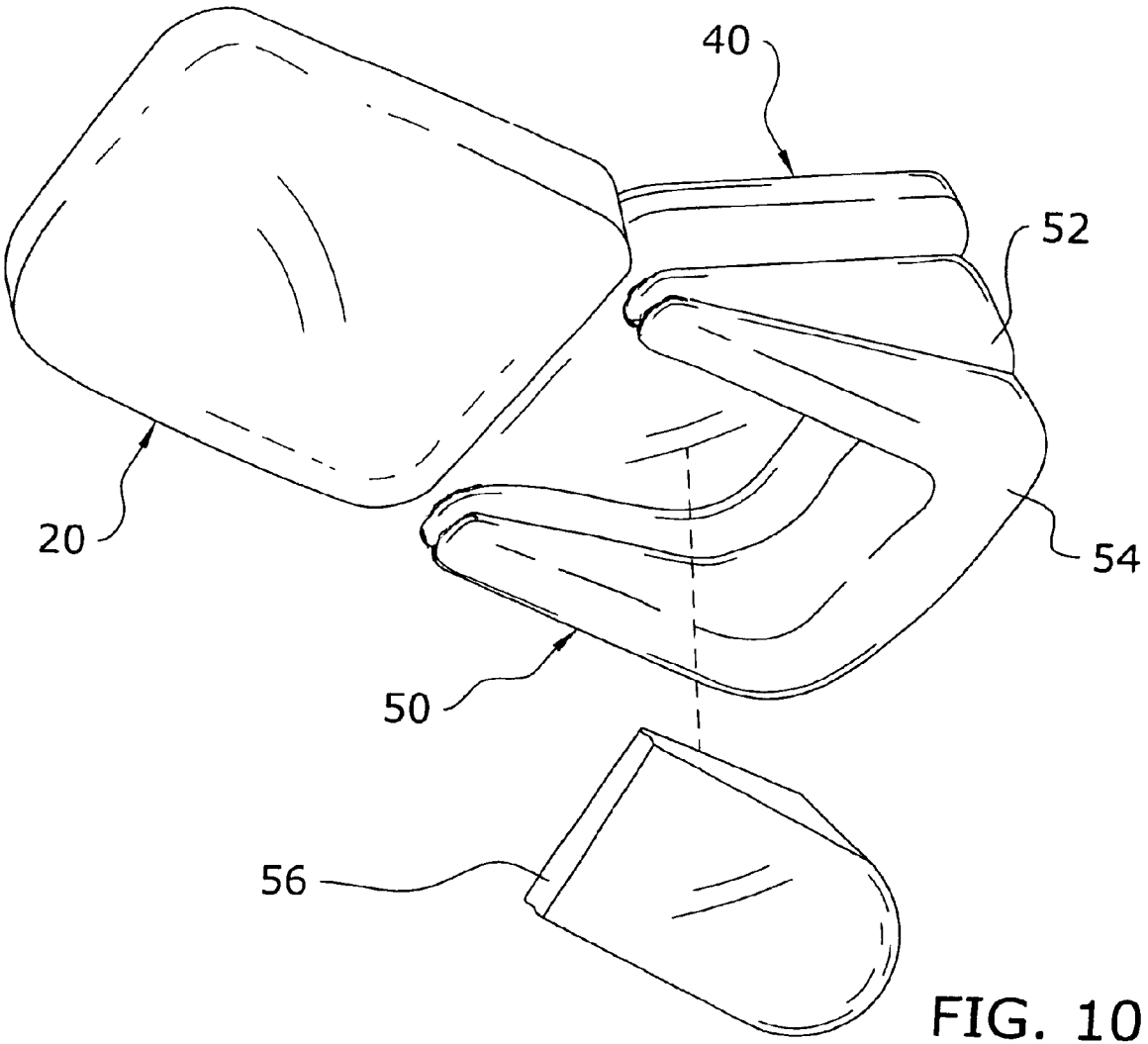
FIG. 10 is an exploded lower perspective view of the support member removed from the bellows unit.
Figure 11:
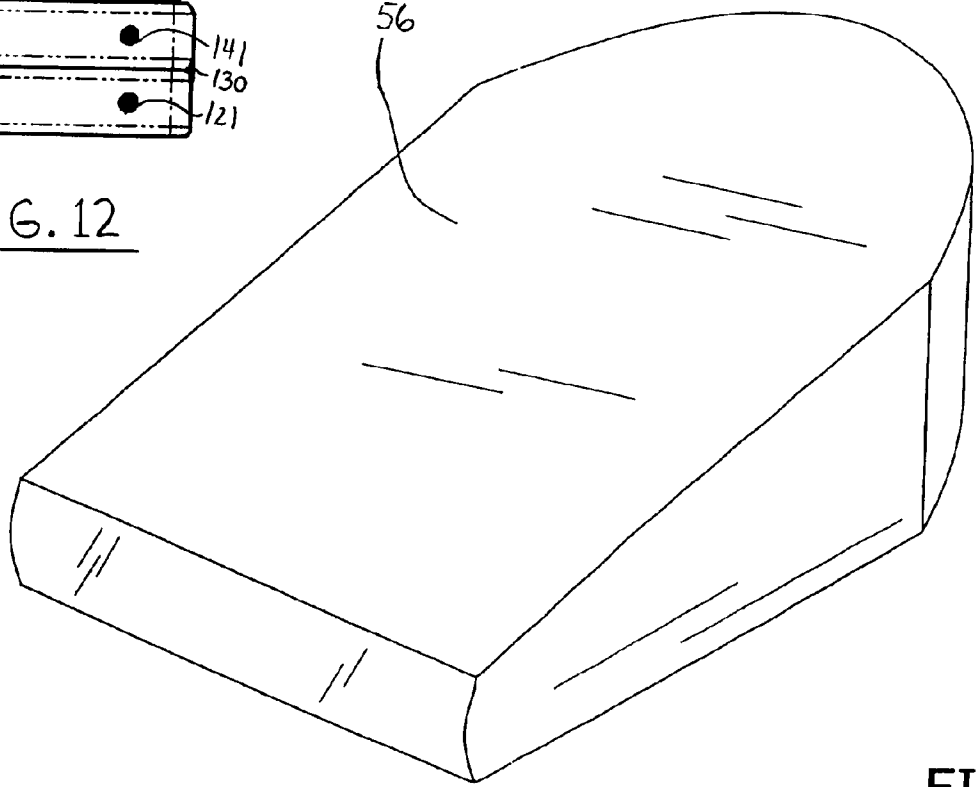
FIG. 11 is a perspective view of the support member.

FIGS. 9 through 11 illustrate the usage of a support member 56 removably positionable within the cavity defined by the bellows unit 50. The support member 56 may be comprised of an inflatable or non-inflatable structure. When the support member 56 is positioned within the cavity of the bellows unit 50, the support member 56 provides additional support to the second mattress 40 thereby preventing sagging of the second mattress 40 when an individual is positioned upon the second mattress 40.

The support member 56 preferably has a tapered structure as shown in FIG. 11 of the drawings. The support member 56 also preferably has a shape similar to the cavity of the bellows unit 50 to provide horizontal support to the side walls of the bellows unit 50. The support member 56 may have various other shapes and structure other than illustrated in the drawings.

H. Operation

The present invention preferably has four main positions: a chair position, a recessed lounge position, a prone bed position and an adjustable lounge position. In use, the user first determines what position they desire. Regardless of the position desired, the user preferably inflates the first mattress 20 and the second mattress 40 as shown in FIG. 4 of the drawings. If the user desires a prone bed position, the user simply lays the first mattress 20 and the second mattress 40 upon a surface in a flat position as shown in FIG. 4 of the drawings with the hinge 30 preferably providing a relatively continuous structure and with the bellows unit 50 remaining deflated under the second mattress 40. As previously indicated, the first and second mattresses may be inflated to different pressures to provide desired support levels for different parts of the body.

If the user desires to have chair position, a recessed lounge position or an adjustable lounge position, the user then inflates the bellows unit 50 to a desired level. For example, if an adjustable lounge is desired the user may only inflate the first bellows 52 and not the second bellows 54 or alternatively only partially inflate the bellows unit 50 to achieve a desired height and angle for the second mattress 40 as illustrated in FIGS. 5 through 7 of the drawings. If a recessed lounge position is desired, the user preferably flips the first and second mattresses so that the bellows unit is atop the second mattress, and fully inflates the bellows unit 50 with the bellows unit 50 in an upright position as shown in FIG. 3 of the drawings. If a chair position is desired, the user inflates the bellows unit 50 and then pivots the first mattress 20 beneath the second mattress 40 as shown in FIG. 2 of the drawings. Importantly, because the first mattress 20 is larger than the second mattress, when the first mattress is beneath the second mattress, a stable chair structure is provided. When the user desires to store the present invention, a pressure relief valve or similar structure may be opened to release the air pressure within the first mattress 20, the second mattress 40 and the bellows unit 50.

While specific sizes, materials, shapes, forms, functions and manners of operation, assembly and use have been provided, it will be recognized by those skilled in the art that they may be varied, and all equivalent structural variations and relationships to those illustrated in the drawings and described in the specification are intended to be encompassed by the present invention. Any headings utilized within the description are for convenience only and have no legal or limiting effect. Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A multiple position air mattress system, comprising:

a first inflatable mattress having a first longitudinal dimension and a first valve for inflation of said first mattress;

a second inflatable mattress pivotally connected to said first mattress such that said first mattress and said second mattress can assume a first position with said first mattress longitudinally adjacent said second mattress and can assume a second position with said first mattress under said second mattress, said second mattress having a second longitudinal dimension smaller than said first longitudinal dimension; and an inflatable bellows unit attached to said second mattress.

2. The multiple position air mattress system of claim 1, further comprising:

a valve fluidly positioned between said second mattress and said bellows unit for allowing airflow from said second mattress to said bellows unit after air pressure within said second mattress has exceeded a desired level.

3. The multiple position air mattress system of claim 1, further comprising:

a pump unit adapted to be coupled to at least one of said first mattress, said second mattress and said bellows unit.

4. The multiple position air mattress system of claim 1, further comprising:

a support member removably positionable with respect to said bellows unit and said second mattress.

5. The multiple position air mattress system of claim 1, wherein said bellows unit is comprised of a plurality of bellows elements.

6. The multiple position air mattress system of claim 5, wherein said bellows unit is comprised of a first bellows attached to said second mattress and a second bellows attached to said first bellows.

7. The multiple position air mattress system of claim 6, wherein said second bellows is fluidly connected to said first bellows.

8. The multiple position air mattress system of claim 6, wherein at least one of said first bellows and said second bellows is provided with an inflation valve such that said first bellows and said second bellows can elevate said second mattress to a desired angle with respect to said first mattress.

9. The multiple position air mattress system of claim 8, wherein said bellows unit includes a second valve fluidly positioned between said first bellows and said second bellows for allowing airflow from said first bellows to said second bellows after the air pressure within said first bellows has exceeded a desired level.

10. The multiple position air mattress system of claim 6, wherein said second bellows is offset relative to said first bellows such that a rear surface of said second bellows, a rear portion of said first bellows, and a rear portion of said second mattress are substantially aligned vertically.

11. The multiple position air mattress system of claim 1, wherein said bellows unit has a U-shaped structure.

12. The multiple position air mattress system of claim 1, including a hinge member attached between said first mattress and said second mattress.

13. The multiple position air mattress system of claim 12, wherein said hinge member is comprised of a flexible flat structure.

14. A multiple position air mattress system, comprising:

a first inflatable mattress;

a second inflatable mattress;

a hinge pivotally connecting said second mattress and said first mattress;

an inflatable bellows unit attached to said second mattress, said inflatable bellows unit having an air inflation/deflation valve which enables a user to control the level of inflation of said inflatable bellows unit, said bellows unit having a structure that is substantially U-shaped with a back and two arms extending downward from said back at an angle when said bellows unit is inflated, wherein said multiple position air mattress system is configurable as a prone bed with said first inflatable mattress longitudinally adjacent said second inflatable mattress and said inflatable bellows unit deflated and under said second inflatable mattress, a recessed lounge with said first inflatable mattress longitudinally adjacent said second inflatable mattress and said inflatable bellows unit inflated atop said second inflatable mattress, an adjustable lounge with said first inflatable mattress longitudinally adjacent said second inflatable mattress and said inflatable bellows unit inflated to a controlled level below said second inflatable mattress to angle said second inflatable mattress relative to said first inflatable mattress, and a chair with said first inflatable mattress under said second inflatable mattress and said inflatable bellows unit inflated atop said second inflatable mattress.

15. The multiple position air mattress system of claim 14, including a support member removably positionable with respect to said bellows unit and said second mattress.

16. The multiple position air mattress system of claim 14, wherein said bellows unit is comprised of a first bellows attached said second mattress and a second bellows attached to said first bellows.

17. The multiple position air mattress system of claim 16, wherein said second bellows is fluidly connected to said first bellows.

18. The multiple position air mattress system of claim 17, wherein each of said first mattress and said second mattress has its own air inflation/deflation valve.

19. The multiple position air mattress system of claim 18, wherein one of said first mattress and said second mattress has an air inflation/deflation valve, and said multiple position air mattress system further includes a second valve fluidly positioned between said first mattress and said second mattress.

20. The multiple position air mattress system of claim 14, wherein said back has a first height and a first width, and said arms taper downward from said first height and taper to narrower widths.

21. The multiple position air mattress system of claim 14, wherein said first mattress has a first longitudinal dimension, and said second mattress has a second longitudinal dimension smaller than said first longitudinal dimension.

22. A multiple position air mattress system, comprising:

a first inflatable mattress having a first valve for inflation of said first mattress;

a second inflatable mattress pivotally connected to said first mattress such that said first mattress and said second mattress can assume a first position with said first mattress longitudinally adjacent said second mattress and can assume a second position with said first mattress under said second mattress, said second mattress having a second valve for inflation of said second mattress; and an inflatable bellows unit attached to said second mattress, said inflatable bellows unit having a third valve for inflation of said bellows unit, said bellows unit having a structure that is substantially U-shaped with a back and two arms extending downward from said back at an angle when said bellows unit is inflated, wherein said bellows unit is adapted to cause said second mattress to assume an angle relative to said first mattress when said bellows unit is located under said second mattress.

23. A multiple position air mattress system according to claim 22, wherein: said inflatable bellows unit is adapted to cause said second mattress to assume an angle of between zero and forty-five degrees relative to said first mattress.

24. A method of manipulating an air mattress system into a position, said system having a first mattress, a second mattress pivotally attached to said first mattress and a bellows unit attached to said first mattress, said position selected from the following group: a chair position, a recessed lounge position, a prone bed position and an adjustable lounge position, said method comprising the steps of:

(a) identifying a desired position of said air mattress system;

(b) inflating said first mattress and said second mattress;

(c) leaving said bellows wilt deflated if said desired position is said prone bed position, and otherwise inflating said bellows unit if said desired position is said chair position, said recessed lounge position or said adjustable lounge position;

(d) having said bellows unit positioned under said second mattress and inflating said bellows unit to cause said second mattress to pivot relative to said first mattress if said desired position is an adjustable lounge position;

(e) having said bellows unit positioned atop said second mattress and inflating said bellows unit if said desired position is a recessed lounge position; and (f) pivoting said first mattress beneath said second mattress with said bellows unit positioned atop said second mattress if said desired position is a chair position.

* * * * *